US009858865B2

(12) United States Patent
Gu et al.

(10) Patent No.: US 9,858,865 B2
(45) Date of Patent: Jan. 2, 2018

(54) DISPLAY DEVICE HAVING A DATA DRIVER FOR SENSING A VOLTAGE LEVEL DIFFERENCE AND METHOD OF DRIVING THE SAME

(71) Applicant: SAMSUNG DISPLAY CO., LTD., Yongin-si, Gyeonggi-do (KR)

(72) Inventors: Bon-Seog Gu, Seongnam-si (KR); Myoung-Seop Song, Asan-si (KR); Myung-Ho Lee, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 13 days.

(21) Appl. No.: 14/992,923

(22) Filed: Jan. 11, 2016

(65) Prior Publication Data

US 2016/0365037 A1 Dec. 15, 2016

(30) Foreign Application Priority Data

Jun. 15, 2015 (KR) ..... 10-2015-0084518

(51) Int. Cl.
*G09G 3/32* (2016.01)
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2300/0842* (2013.01); *G09G 2320/0233* (2013.01); *G09G 2330/028* (2013.01)

(58) Field of Classification Search
CPC ..... G09G 3/3291
USPC ..... 345/82
See application file for complete search history.

(56) References Cited

U.S. PATENT DOCUMENTS

2004/0252089 A1* 12/2004 Ono ..... G09G 3/3233 345/82
2008/0180365 A1* 7/2008 Ozaki ..... G09G 3/3233 345/76
2012/0086694 A1* 4/2012 Tseng ..... G09G 3/3233 345/212
2012/0200558 A1* 8/2012 Okumura ..... G09G 3/3655 345/212
2015/0154899 A1* 6/2015 Chang ..... G09G 3/3233 345/76
2015/0187268 A1* 7/2015 Tani ..... G09G 3/3233 345/77
2015/0187276 A1* 7/2015 Shim ..... G09G 3/3233 345/77

FOREIGN PATENT DOCUMENTS

KR 1999-009765 A 2/1999
KR 2000-0050878 A 8/2000
KR 10-2005-0005198 A 1/2005
KR 10-2006-0022787 A 3/2006
KR 10-2014-0027860 A 3/2014

* cited by examiner

*Primary Examiner* — Long D Pham
(74) *Attorney, Agent, or Firm* — Lewis Roca Rothgerber Christie LLP

(57) ABSTRACT

A display device includes a power supplier that generates a first power voltage, a display panel that includes a pixel generating a sensing signal by sensing a local voltage level of the first power voltage using a storage capacitor, and a data driver that generates a data signal based on image data and the sensing signal.

20 Claims, 8 Drawing Sheets

DISPLAY DEVICE HAVING A DATA DRIVER FOR SENSING A VOLTAGE LEVEL DIFFERENCE AND METHOD OF DRIVING THE SAME

CROSS-REFERENCE TO RELATED APPLICATION

This application claims priority to, and the benefit of, Korean Patent Application No. 10-2015-0084518, filed on Jun. 15, 2015 in the Korean Intellectual Property Office (KIPO), the contents of which are incorporated herein in its entirety by reference.

BACKGROUND

1. Field

Example embodiments relate to a display device. More particularly, embodiments of the present invention relate to a display device employing a dual scan technique, and a method of driving the display device.

2. Description of the Related Art

As a resolution of a display panel is increased, a driving time of a pixel (or, a pixel column) that is included in the display panel, and a compensation time for compensating a threshold voltage of the pixel, are reduced.

Recently, a display device that secures the driving time or the compensation time that is longer than that of the typical display device by employing a dual scan technique has been suggested. However, when the display device operates based on the dual scan technique, respective display regions of the display panel (e.g., an upper display region and a lower display region, which are divided with respect to a center line of the display panel) use different scan signals and have different line resistances. Thus, a current-resistance drop (which may be referred to as "IR drop," or an ohmic drop) of a power voltage (or of a data signal) occurs differently in respective display regions, and a luminance difference (or, a brightness difference) may be seen at a border between the display regions.

SUMMARY

Some example embodiments provide a display device that can control pixels to emit light with the same or substantially the same luminance, even when a power voltage supplied to each of the pixels is differently dropped (i.e., even when different current-resistance drops occur).

Some example embodiments provide a method of driving a display device that drives the display device.

According to example embodiments, a display device may include a power supply configured to generate a first power voltage, a display panel including a pixel that generates a sensing signal by sensing a local voltage level of the first power voltage using a storage capacitor, and a data driver configured to generate a data signal based on image data and the sensing signal.

In example embodiments, the display panel may further include a sensing data line that transfers the sensing signal to the data driver.

In example embodiments, the pixel may include a light emitting element, a driving transistor including a first electrode that receives the first power voltage, a second electrode that is electrically connected to the light emitting element, and a gate electrode that receives the data signal, and a sensing transistor including a first electrode that is electrically connected to the first electrode of the driving transistor, a second electrode that is electrically connected to the sensing data line, and a gate electrode that receives a sensing control signal, wherein the storage capacitor is electrically connected between the first electrode of the driving transistor and the gate electrode of the driving transistor.

In example embodiments, the pixel may sense a voltage at a terminal of the storage capacitor as the local voltage level when a supply of the first power voltage is stopped.

In example embodiments, the display device may further include a gate driver that generates a scan signal and a sensing control signal and to provide the display panel with the scan signal and the sensing control signal, where the gate driver controls the pixel to store the data signal in the storage capacitor based on the scan signal and controls the pixel to sense the local voltage level based on the sensing control signal.

In example embodiments, the display device may further include a timing controller that generates a power control signal and to control the power supply to stop a supply of the first power voltage based on the power control signal.

In example embodiments, the display panel may include a plurality of display regions, and the gate driver may provide mutually independent scan signals to the display regions.

In example embodiments, the data driver may calculate a voltage difference between the sensing signal and a voltage level of the first power voltage and may generate the data signal based on the image data and the voltage difference.

In example embodiments, the data driver may generate a first data signal based on the image data, may compensate the first data signal based on the voltage difference, and may output a compensated first data signal as the data signal.

In example embodiments, the data driver may reduce the first data signal by the voltage difference.

In example embodiments, the power supply may sense the supply voltage level of the first power voltage.

According to example embodiments, a display device may include a power supply configured to generate a first power voltage, a display panel configured to generate a sensing signal by sensing a local voltage level of the first power voltage, and a data driver configured to generate a data signal based on image data and the sensing signal, where the display panel may include a first pixel column including a first pixel that generates the sensing signal by sensing the local voltage level using a storage capacitor, and a second pixel column including a second pixel that emits light based on the data signal.

In example embodiments, the display panel includes a sensing data line that is electrically connected between the first pixel column and the data driver, the sensing data line transferring the sensing signal to the data driver.

In example embodiments, the first pixel may include a light emitting element, a driving transistor including a first electrode that receives the first power voltage, a second electrode that is electrically connected to the light emitting element, and a gate electrode that receives the data signal, and a sensing transistor including a first electrode that is electrically connected to a first electrode of the driving transistor, a second electrode that is electrically connected to the sensing data line, and a gate electrode that receives a sensing control signal, wherein the storage capacitor is electrically connected between the first electrode of the driving transistor and the gate electrode of the driving transistor.

In example embodiments, the first pixel may sense a voltage at a terminal of the storage capacitor as the local voltage level when a supply of the first power voltage is stopped.

In example embodiments, the data driver may calculate a voltage difference between the sensing signal and a supply voltage level of the first power voltage and generates the data signal based on the image data and the voltage difference.

In example embodiments, the display device may further include a gate driver that generates a scan signal and a sensing control signal and to provide the display panel with the scan signal and the sensing control signal, where the gate driver controls the first pixel to store the data signal in the storage capacitor based on the scan signal and controls the first pixel to sense the local voltage level based on the sensing control signal.

According to example embodiments, a method of driving a display device including a pixel, where the pixel includes a light emitting element, a driving transistor that includes a first electrode receiving a first power voltage, a second electrode electrically connected to the light emitting element, and a gate electrode receiving a data signal, and a storage capacitor that is electrically connected between the first electrode of the driving transistor and the gate electrode of the driving transistor, the method may include supplying a second data signal to the pixel, generating a sensing signal by sensing a voltage at a terminal of the storage capacitor as a local voltage level of the first power voltage, and generating the data signal based on image data and the sensing signal.

In example embodiments, generating the sensing signal may include stopping a supply of the first power voltage, disconnecting the driving transistor and the light emitting element, and sensing the voltage at the terminal of the storage capacitor.

In example embodiments, generating the data signal may include calculating a voltage difference between the sensing signal and a supply voltage level of the first power voltage, and generating the data signal based on the image data and the voltage difference.

Therefore, a display device according to example embodiments may control pixels to emit light with the same or substantially the same luminance even when a current-resistance drop of a first power voltage is different at each pixel by sensing a local voltage level of a high power voltage using a storage capacitor of a pixel, which stores a data signal, and by generating the data signal based on the local voltage level. In addition, a method of driving a display panel according to example embodiments may efficiently drive the display panel

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
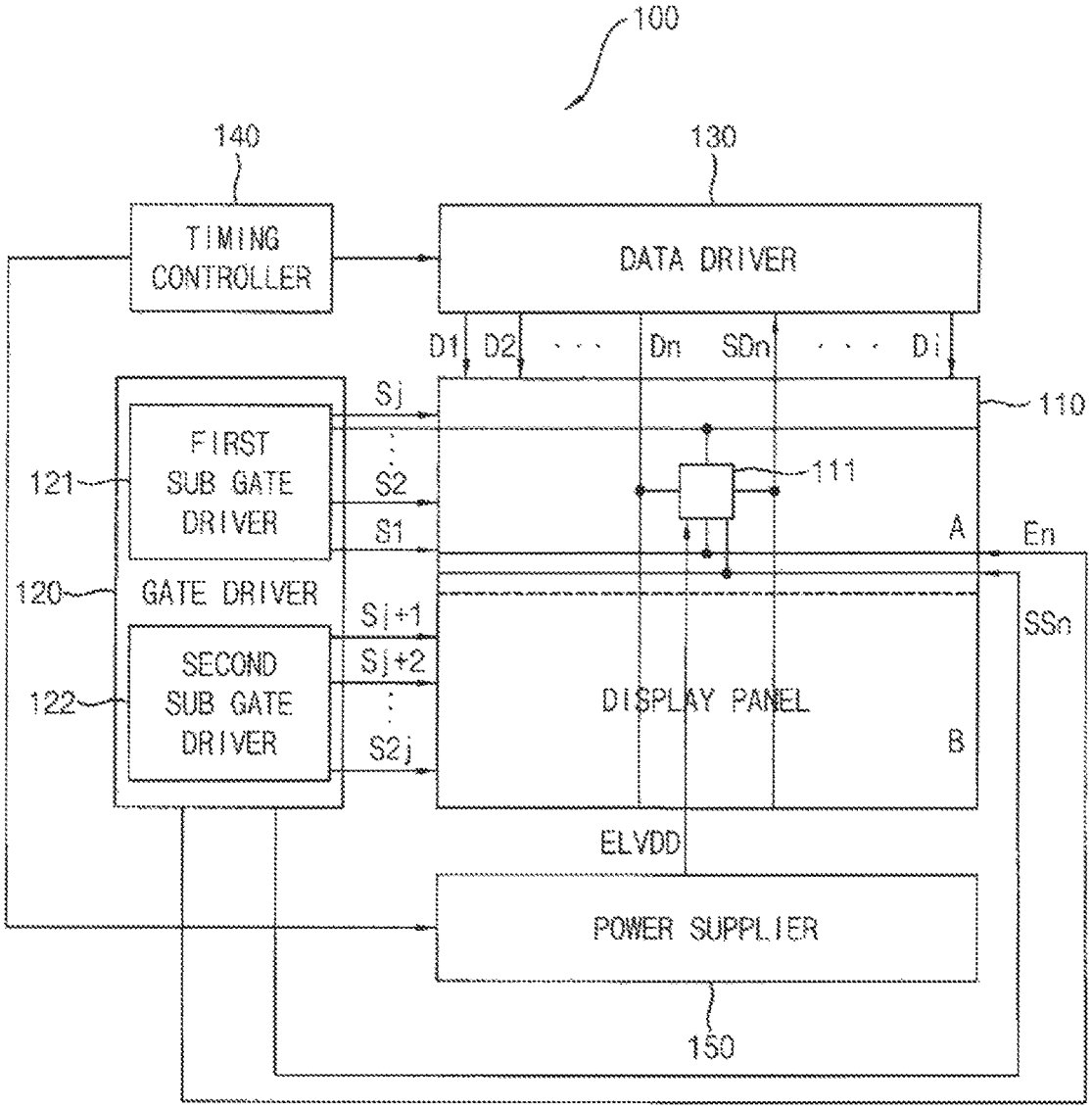
FIG. 1 is a block diagram illustrating a display device according to example embodiments.

Hereinafter, the present invention will be explained in detail with reference to the accompanying drawings.

It will be understood that, although the terms "first", "second", "third", etc., may be used herein to describe various elements, components, regions, layers, and/or sections, these elements, components, regions, layers and/or sections should not be limited by these terms. These terms are used to distinguish one element, component, region, layer or section from another element, component, region, layer or section. Thus, a first element, component, region, layer, or section discussed below could be termed a second element, component, region, layer, or section, without departing from the spirit and scope of the present invention.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

Further, it will also be understood that when one element, component, region, layer and/or section is referred to as being "between" two elements, components, regions, layers, and/or sections, it can be the only element, component, region, layer and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Further "connection," "connected," etc. may also refer to "electrical connection," "electrically connect," etc. depending on the context in which they are used as those skilled in the art would appreciate. When an element or layer is referred to as being "directly on," "directly connected to," "directly coupled to," "directly connected with," "directly coupled with," or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

FIG. 1 is a block diagram illustrating a display device according to example embodiments.

Referring to FIG. 1, the display device 100 may include a display panel 110, a gate driver 120 (e.g., a scan driver 120), a data driver 130, a timing controller 140, and a power supplier 150 (e.g., a power supply 150).

The display device 100 may display an image based on externally supplied image data. For example, the display device 100 may be an organic light emitting display device. The display panel 110 may include scan lines S1 through S2*j*, data lines D1 through Di, and pixels 111 respectively arranged in crossing regions of the scan lines S1 through S2*j* and the data lines D1 through Di. The display panel 110 may include a light emission control line En, at least one sensing control line SSn, and at least one sensed data line.

Each of the pixels 111 may store a respective data signal supplied through the data lines D1 through Di in response to a scan signal supplied through the scan lines S1 through S2*j*. Each of the pixels 111 may emit light based on the stored data signal in response to the light emission control signal through the light emission control line En.

In example embodiments, at least one pixel 111 among pixels may generate a sensing signal by sensing/measuring/detecting a local voltage level of a first power voltage ELVDD (e.g., a first power voltage supplied to the display panel 110 for driving the pixel 111) by using a storage capacitor. Here, the storage capacitor may store the externally supplied data signal, and may be electrically connected between a data line Dn and a first line for transferring the first power voltage ELVDD.

For example, the pixel 111 may charge the storage capacitor based on the externally supplied data signal, and may sense a voltage at a terminal of the storage capacitor as the local voltage level corresponding to the first power voltage ELVDD when a supply of the first power voltage ELVDD is stopped (or, interrupted). A configuration of the pixel 111 to sense the local voltage level will be explained in detail with reference to FIG. 2A. The pixel 111 may provide the local voltage level (or, sensing signal) to the data driver 130 through a sensed data line SDn in response to a sensing control signal.

The display panel 110 may include display regions A and B. For example, the display panel 110 may include an upper display region A and a lower display region B that are divided based on an horizontal axis located at a center of the display panel 110 (e.g., the dashed line shown in FIG. 1).

The gate driver 120 may receive a scan driving control signal from the timing controller 140, and may generate a scan signal SCAN[n], a light emission control signal EM, and a sensing control signal SENSING SCAN[n] (see FIG. 2A) based on the scan driving control signal. The gate driver 120 may provide the scan signal SCAN[n], the light emission control signal EM, and the sensing control signal SENSING SCAN[n] to the pixel 111 through the scan lines S1 through S2*j*, the light emission control line En, and at least one sensing control line SSn. Here, the scan driving control signal may include a start pulse and clock signals, and may include a shift register for sequentially generating the scan signal SCAN[n] or the light emission control signal EM corresponding to the start pulse and the clock signals.

The gate driver 120 may control the pixel 111 to store the data signal in the storage capacitor based on the scan signal SCAN[n] and to sense the local voltage level of the first power voltage ELVDD supplied to the pixel 111.

In example embodiments, the gate driver 120 may include sub gate drivers 121 and 122 (e.g., gate driving units 121 and 122) for supplying at least one of the scan signal SCAN[n], the light emission control signal EM, and the sensing control signal SENSING SCAN[n] to the display regions A and B, respectively. For example, the gate driver 120 may include a first sub gate driver 121 for supplying the scan signal SCAN[n] to the upper display region A, and a second sub gate driver 122 for supplying the scan signal SCAN[n] to the lower display region B. Here, the first sub gate driver 121 and the second sub gate driver 122 may provide mutually independent scan signals to the display panel 110. For example, the first sub gate driver 121 may sequentially provide the scan signal SCAN[n] to the upper display region A through some scan lines (e.g., S1 through Sj), and the second sub gate driver 122 may sequentially provide the scan signal SCAN[n] to the lower display region B through remaining scan lines (e.g., Sj+1 through S2*j*). That is, the gate driver 120 may provide at least one selected from the scan signal SCAN[n], the light emission control signal EM, and the sensing control signal SENSING SCAN[n] by employing a multi scan technique (e.g., a dual scan technique).

The data driver 130 may provide the data signal to the display panel 110. The data driver 130 may generate the data signal based on image data supplied from the timing controller 140, and may provide the data signal to the display panel 110 (or to the pixels) through the data lines D1 through Di in response to a data driving control signal.

In example embodiments, the data driver 130 may generate the data signal based on image data and the sensing signal (e.g., SENSED DATA in FIG. 2) generated by the pixel 111. For example, the data driver 130 may calculate a voltage difference between the sensing signal and a supply voltage level of the first power voltage ELVDD, and may generate the data signal based on the image data and the voltage difference. The supply voltage level of the first power voltage ELVDD may be sensed/measured/detected by the power supplier 150, and the sensed supply voltage level may be provided to the data driver 130 directly or through the timing controller 140. A configuration of the data driver 130 for generating the data signal will be explained in detail with reference to the FIG. 3.

The timing controller 140 may control operations of the display panel 110, the gate driver 120, the data driver 130, and the power supplier 150. The timing controller 140 may generate a clock signal, the scan driving control signal, and the light emission control signal, and may provide them to the gate driver 120. The timing controller 140 may generate the data driving control signal, and may provide the driving control signal to the data driver 130. The timing controller 140 may generate a power control signal, and may control the power supplier 150 to stop a supply of the first power voltage ELVDD based on the power control signal.

As described above, the display device 100 according to example embodiments may control the pixels to emit light with the same or substantially the same luminance when the display device 100 has a current-resistance drop ("IR drop") of the first power voltage ELVDD that is different for each pixel, because the display device 100 may generate the sensing signal by sensing the local voltage level of the first power voltage ELVDD using the storage capacitor of the pixel 111, and by generating the data signal based on the image data and the sensing signal.

Figure 2A:
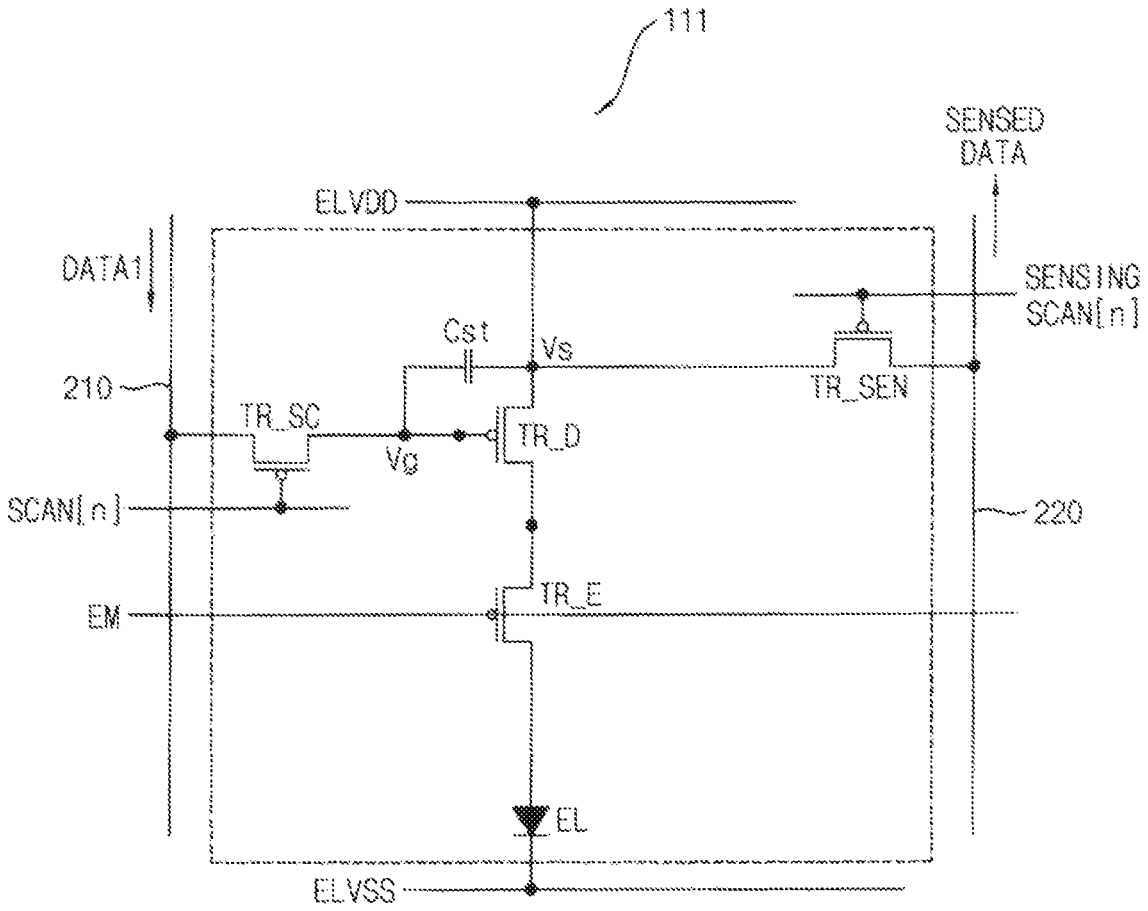
FIG. 2A is a diagram illustrating an example of a pixel included in the display device of FIG. 1.

FIG. 2A is a diagram illustrating an example of a pixel included in the display device of FIG. 1.

Referring to FIG. 2A, the pixel 111 may include a switching transistor TR_SC, a storage capacitor Cst, a driving transistor TR_D, a light emitting transistor TR_E, a light emitting element EL, and a sensing transistor TR_SEN.

The switching transistor TR_SC may include a first electrode electrically connected to a first data line 210, a second electrode electrically connected to a gate electrode of the driving transistor TR_D, and a gate electrode for receiving the scan signal SCAN[n]. The switching transistor TR_SC may transfer a first data signal DATA1 supplied through the first data line 210 to a gate electrode of the driving transistor TR_D in response to the scan signal SCAN[n].

The storage capacitor Cst may be electrically connected between a first line for transferring the first power voltage ELVDD and the gate electrode of the driving transistor TR_D. The storage capacitor Cst may store the data signal supplied to a gate electrode of the driving transistor TR_D.

The driving transistor TR_D may include a first electrode for receiving the first power voltage ELVDD, a second electrode electrically connected to a first electrode of the light emitting transistor TR_E, and the gate electrode for receiving the data signal DATA1. The driving transistor TR_D may transfer a driving current based on the first data signal DATA1 stored in the storage capacitor Cst.

The light emitting transistor TR_E may include a first electrode electrically connected to the second electrode of the driving transistor TR_D, a second electrode electrically connected to the light emitting element EL, and a gate electrode for receiving the light emitting control signal EM. The light emitting transistor TR_E may couple (or, connect) the driving transistor TR_D and the light emitting element EL in response to the light emitting control signal EM.

The light emitting element EL may be electrically connected between the light emitting transistor TR_E and a second line for transferring the second power voltage ELVSS, and may emit light based on the driving current supplied according to an operation of the light emitting transistor TR_E. For example, the light emitting element EL may be an organic light emitting diode.

The sensing transistor TR_SEN may include a first electrode electrically connected to the first electrode of the driving transistor TR_D, a second electrode electrically connected to a second data line 220 (e.g., a sensed data line 220), and a gate electrode for receiving the sensing control signal SENSING SCAN[n]. The sensing transistor TR_SEN may sense a voltage Vs at a first node based on the sensing control signal SENSING SCAN[n], and may output a sensed voltage Vs (e.g., SENSED DATA) through the second data line 220 to the outside. Here, the first node may be electrically connected to the first power voltage ELVDD, the driving transistor TR_D, and the storage capacitor Cst.

In FIG. 2A, the first data line 210 and the second data line 220 may be spaced apart in the display panel 110. However, the first data line 210 and the second data line 220 are not limited thereto. For example, the first data line 210 and the second data line 220 may be formed as one line, and one line may transfer the first data signal DATA1 and the sensing signal SENSED DATA during different times.

In example embodiments, the pixel 111 may sense a local voltage level of the first power voltage ELVDD using the storage capacitor Cst, and may generate the sensing signal SENSED DATA.

Figure 2B:
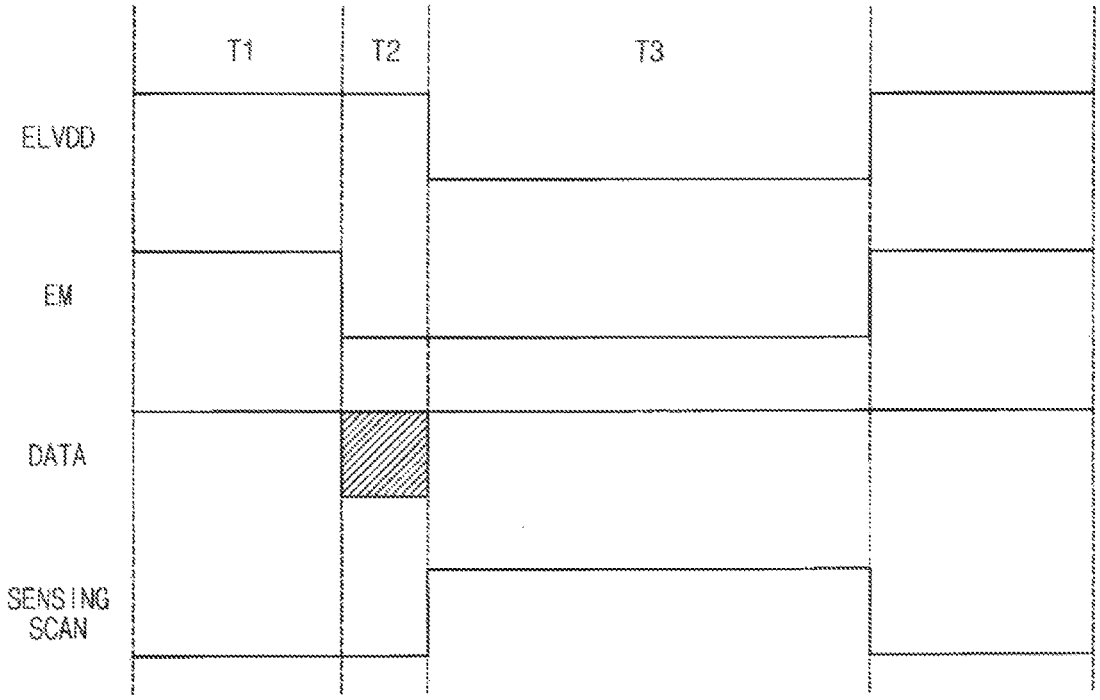
FIG. 2B is a waveform diagram illustrating an operation of the pixel of FIG. 2A.

FIG. 2B is a waveform diagram illustrating an operation of the pixel of FIG. 2A.

Referring to FIGS. 2A and 2B, a first period T1 may be a power stabilization period, in which the first power voltage ELVDD may be supplied to the pixel 111. Here, signals other than the first power voltage ELVDD may have any value.

The second period T2 may be a data writing period. In the second period T2, the pixel 111 may store the first data signal DATA1, which is transferred through the first data line 210, in the storage capacitor Cst. For example, the first data signal DATA1 may be any value, and the scan signal SCAN[n] may have a turn-on level (i.e., a turn-on voltage level). Here, the pixel 111 may turn on the switching transistor TR_SC in response to the scan signal SCAN[n], may transfer the first data signal DATA1 to the gate electrode of the driving transistor TR_D, and may store the first data signal DATA1 in the storage capacitor Cst, where the first data signal DATA1 may be any voltage supplied to sense the local voltage level of the first power voltage ELVDD. When the light emitting control signal EM has a turn-off level (i.e., a turn-off voltage level), the pixel 111 may turn off the light emitting transistor TR_E, and may stop (or, interrupt) a flow of the driving current supplied to the light emitting element EL.

The storage capacitor Cst may be charged with a voltage difference between a third power voltage and the first data signal DATA1 (i.e., the third power voltage—the first data signal DATA1). Here, the third power voltage may have a local voltage level of the first power voltage ELVDD, where the first power voltage ELVDD has a voltage drop due to line resistances and is supplied to the pixel 111.

The third period T3 may be a sensing period. In the third period T3, the pixel 111 may sense a local voltage level of the first power voltage ELVDD based on the data signal stored in the storage capacitor Cst. The first power voltage ELVDD supplied to the pixel 111 may have a low voltage level. That is, a supply of the first power voltage ELVDD to the pixel 111 may be stopped (or, interrupted). The sensing control signal SENSING SCAN may have a logic low level. Here, the pixel 111 may turn on the sensing transistor TR_SEN and may output a stored voltage (i.e., a voltage Vs of the first node) through the second data line 220 to the outside. Therefore, the pixel 111 may sense the voltage Vs at the first node as the local voltage level of the first power voltage ELVDD, and may output the local voltage level as the sensing signal SENSED DATA to the outside (e.g., to a read-out apparatus or to the data driver 130) when a supply of the first power voltage ELVDD is stopped.

The pixel 111 may sense the local voltage level at a first driving of the display panel 110 (i.e., when the display panel 110 is driven for the first time), or at an initial driving of the display panel 110 (i.e., when the display panel 110 is initialized). That is, the gate driver 120 may provide the sensing control signal SENSING SCAN to the display panel 110 at a first driving point or at an initial driving point of the display panel 110, and the pixel 111 may sense the local voltage level in response to the sensing control signal SENSING SCAN.

As described above, the pixel 111 may store the first data signal DATA1 in the storage capacitor Cst in response to the scan signal SCAN[n], may sense a charged voltage of the storage capacitor Cst in response to the sensing control signal SENSING SCAN, and may generate the sensing signal SENSED DATA based on a sensed voltage.

Figure 3:
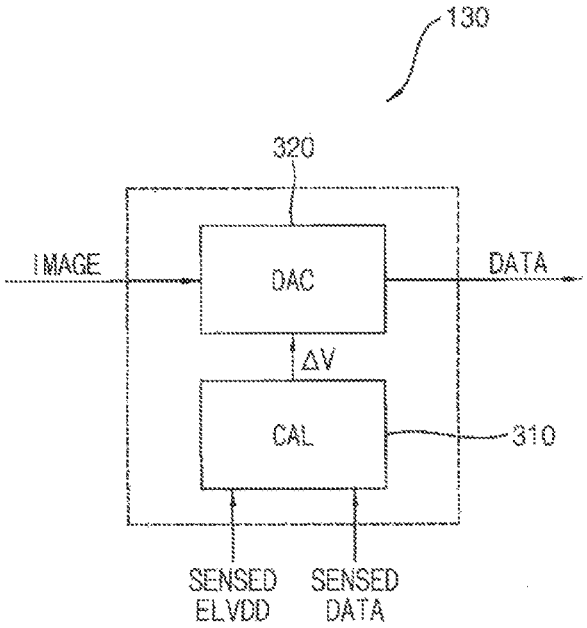
FIG. 3 is a block diagram illustrating an example of a data driver included in the display device of FIG. 1.

FIG. 3 is a block diagram illustrating an example of a data driver included in the display device of FIG. 1.

Referring to FIGS. 2A and 3, the data driver 130 may include a voltage difference calculator 310 (e.g., CAL 310) and a data signal generator 320 (e.g., DAC 320).

The voltage difference calculator 310 may calculate a voltage difference ΔV between the sensing signal SENSED DATA (i.e., the local voltage level of the first power voltage ELVDD) and the supply voltage level SENSED ELVDD. For example, the voltage difference calculator 310 may receive the sensing signal SENSED DATA from the pixel 111, and may receive the supply voltage level SENSED ELVDD from the power supplier 150. The voltage difference calculator 310 may calculate the voltage difference ΔV by differentially amplifying the sensing signal SENSED DATA and the supply voltage level SENSED ELVDD.

The voltage difference calculator 310 may calculate the voltage difference ΔV at a first driving point or at an initial driving point of the display panel 110, and may store a calculated voltage difference ΔV.

The data signal generator 320 may generate a data signal DATA based on externally supplied image data IMAGE and the calculated voltage difference ΔV.

In an example embodiment, the data driver 130 may generate the first data signal DATA1 based on the image data IMAGE, may compensate the first data signal DATA1 based on the calculated voltage difference ΔV, and may output a compensated first data signal DATA1 as the data signal DATA.

For example, the data driver 130 may generate the first data signal DATA1 corresponding to the image data IMAGE based on a gamma curve, where the gamma curve may represent a relation between a grayscale/gray level of the image data IMAGE and a gray level voltage. The data driver 130 may output the data signal DATA by increasing or decreasing the first data signal DATA1 by the voltage difference ΔV.

Figure 4:
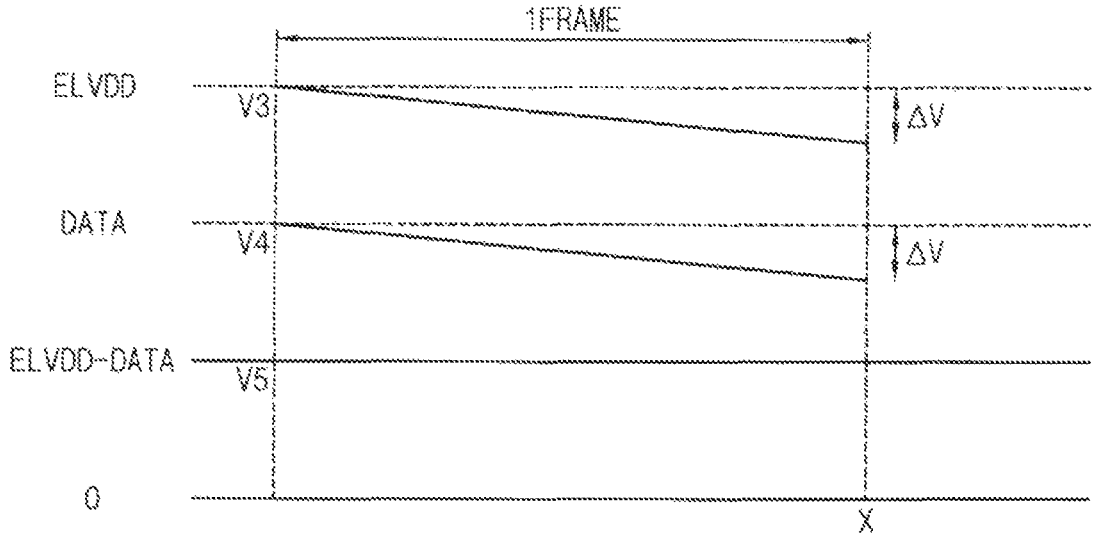
FIG. 4 is a waveform diagram illustrating an example of a data signal generated by the data driver of FIG. 3.

FIG. 4 is a waveform diagram illustrating an example of a data signal generated by the data driver of FIG. 3.

Referring to FIGS. 2 through 4, the supply voltage level SENSED ELVDD of the first power voltage ELVDD supplied to the pixel 111 may be V3 (volts), and the local voltage level of the first power voltage ELVDD may have a voltage lower than that of the supply voltage level SENSED ELVDD. A path (or, a line resistance of the path) for transferring the first power voltage ELVDD to the pixel 111 may be different depending on a position of pixel 111 (i.e., a position of the pixel 111 on the display panel 110) and may therefore cause a different current-resistance drop. Therefore, the local voltage level may be different for each pixel 111. For example, the local voltage level may be lowered in proportion to a distance between the power supplier 150 and the pixel 111. For example, at a certain point, the local voltage level may be "V3−ΔV," which is lower than the supply voltage level SENSED ELVDD by the voltage difference ΔV.

The pixel 111 located (or, arranged) at the certain point may sense "V3−ΔV" as the local voltage level. The data driver 130 may calculate a voltage difference ΔV based on the local voltage level (i.e., V3−ΔV) and the supply voltage level (V3), and may generate the data signal DATA based on the voltage difference ΔV.

As describe in FIG. 4, the data driver 130 may generate the data signal having a lower level than the first data signal DATA1 according to lowering of the local voltage level of the first power voltage ELVDD. Here, a reduced level (or, a level difference) of the data signal DATA may be the same as, or similar to, that of the local voltage level, or may be in proportion to that of the local voltage level. Therefore, even though a change of a current-resistance drop of the first power voltage ELVDD, a voltage difference between the local voltage level of the first power voltage ELVDD and the data signal DATA (i.e., ELVDD-DATA) may be kept constant. In addition, the pixel 111 may emit light with a constant luminance even though the current-resistance drop of the first power voltage ELVDD is changed.

In FIG. 4, the supply voltage level of the first power voltage ELVDD has a constant level. However, the supply voltage level of the first power voltage ELVDD is not limited thereto. For example, the supply voltage level of the first power voltage ELVDD may be changed based on an on-pixel ratio ("OPR") of the display panel 110.

Figure 5:
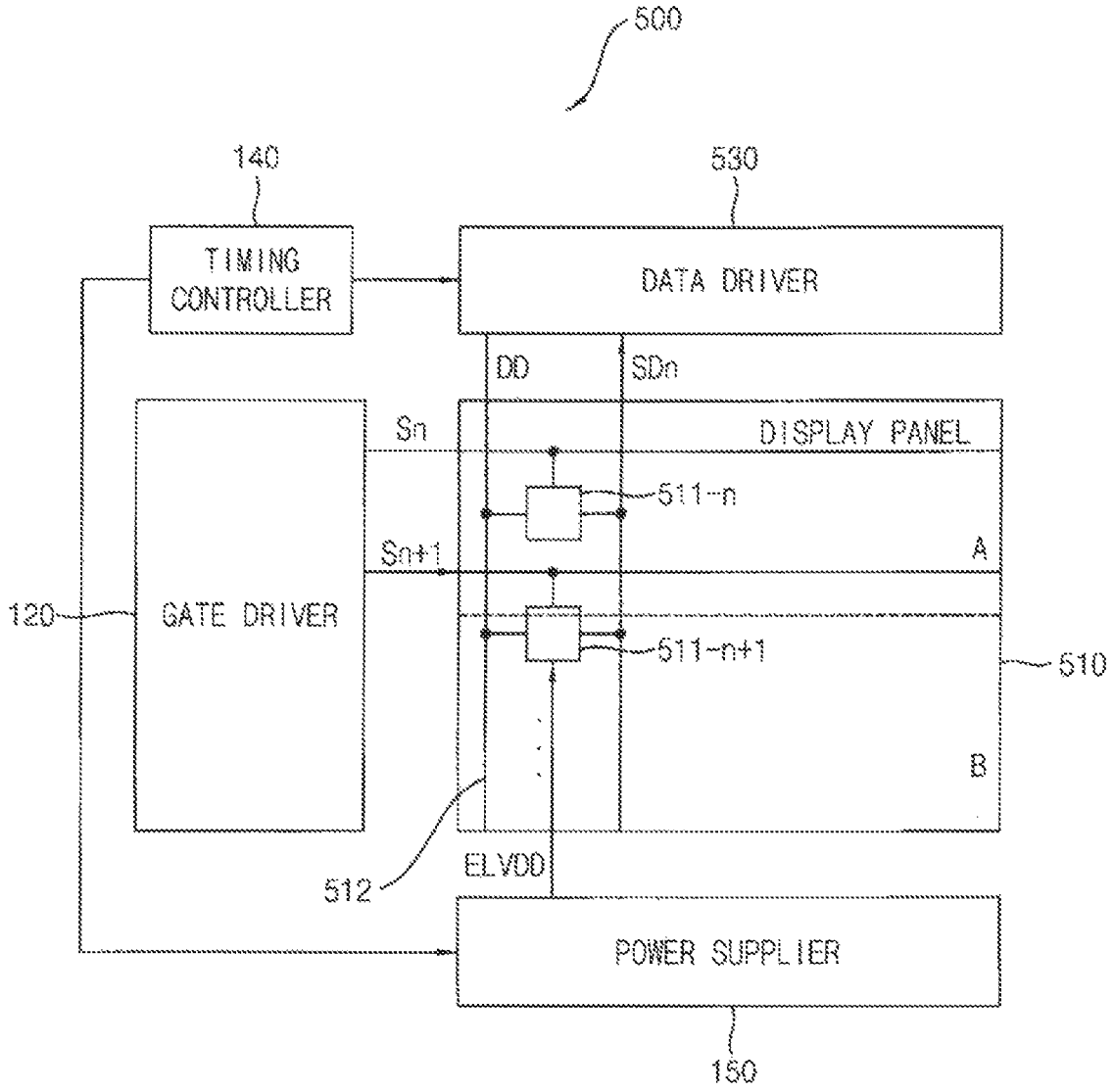
FIG. 5 is a block diagram illustrating an example of the display device of FIG. 1.

FIG. 5 is a block diagram illustrating an example of the display device of FIG. 1.

Referring to FIG. 5, the display device 500 may include a display panel 510, a gate driver 120 (e.g., a scan driver 120), a data driver 530, a timing controller 140, and a power supplier 150 (e.g., a power supply 150).

The display device 500 may be the same as, or similar to, the display device 100 described with reference to FIG. 1. The gate driver 120, the timing controller 140, and the power supplier 150 may the same as, or similar to, the gate driver 120, the timing controller 140, and the power supplier 150 included in the display device 100 of FIG. 1. Thus, duplicated description will not be repeated.

Compared to the display panel 110 described in FIG. 1, the display panel 510 may include a dummy data line 512 and a first pixel column (or, a dummy pixel column) electrically connected to the dummy data line 512. Here, the first pixel column may include a first pixel for sensing a local voltage level of the first power voltage ELVDD and for generating a sensing signal based on the local voltage level. That is, the display panel 510 may include a first pixel column including the first pixel 511 that generates the sensing signal by sensing the local voltage level using a storage capacitor, and may include a second pixel column including a second pixel for emitting light based on the data signal.

As described in FIG. 5, the first pixel column may be arranged adjacent the gate driver 120. That is, the first pixel column may be arranged in the left side of the display panel 510. However, the first pixel column is not limited thereto.

For example, the first pixel column may be arranged in the right side of the display panel 510.

The first pixel 511 included in the first pixel column may be the same as, or similar to, the pixel 111 of FIG. 2A. The second pixel included in the second pixel column (i.e., another suitable pixel column, excluding the dummy pixel column) may be the same as, substantially the same as, or different from the pixel 111 of FIG. 2A. For example, the second pixel might not include the sensing transistor TR_SEN included in the pixel 111 of FIG. 2A.

The data driver 530 may generate a data signal supplied to the second pixel (or, the second pixel column) based on the sensing signal generated by the first pixel 511 (or by a pixel of the first pixel column). The first power voltage ELVDD supplied to pixels arranged in the same pixel column have the same or substantially the same current-resistance drop. Therefore, the data driver 130 may generate the data signal supplied to the second pixel (or to pixels arranged in the pixel column including the first pixel 511) based on the local voltage level of the first power voltage ELVDD sensed by the first pixel 511.

A configuration of the data driver 530 to generate the data signal may be the same as, or similar to, that of the data driver 130 described with reference to FIG. 3. Thus, duplicated description will not be repeated.

As described above, the display device 500 may include a first pixel 511 (or a dummy pixel) for sensing the local voltage level of the power voltage ELVDD for each pixel column, and may generate the data signal supplied to other suitable pixels based on the local voltage level sensed by the first pixel 511 (or by the dummy pixel).

Figure 6A:
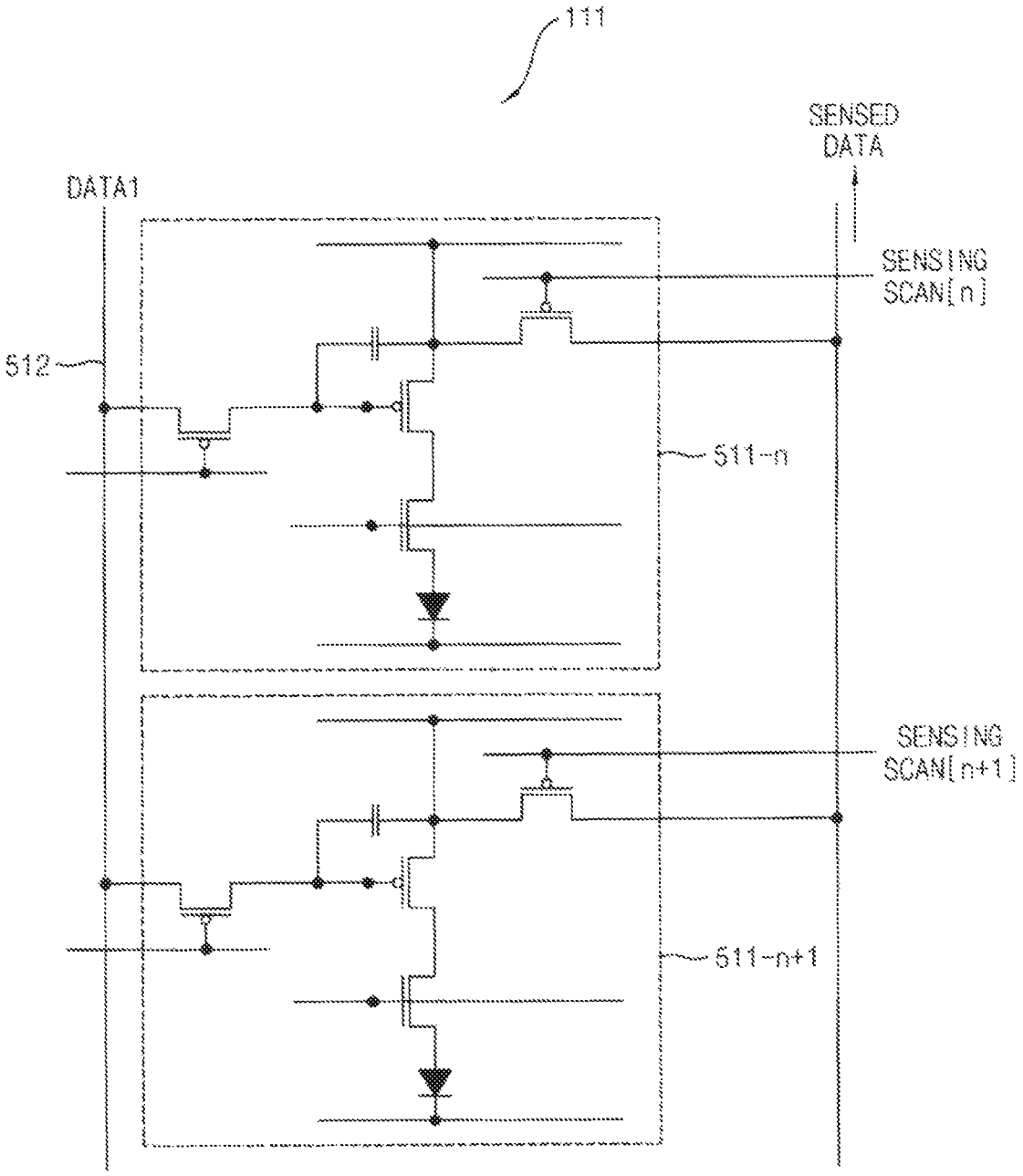
FIG. 6A is a circuit diagram illustrating an example of a first pixel column included in the display device of FIG. 5.
Figure 6B:
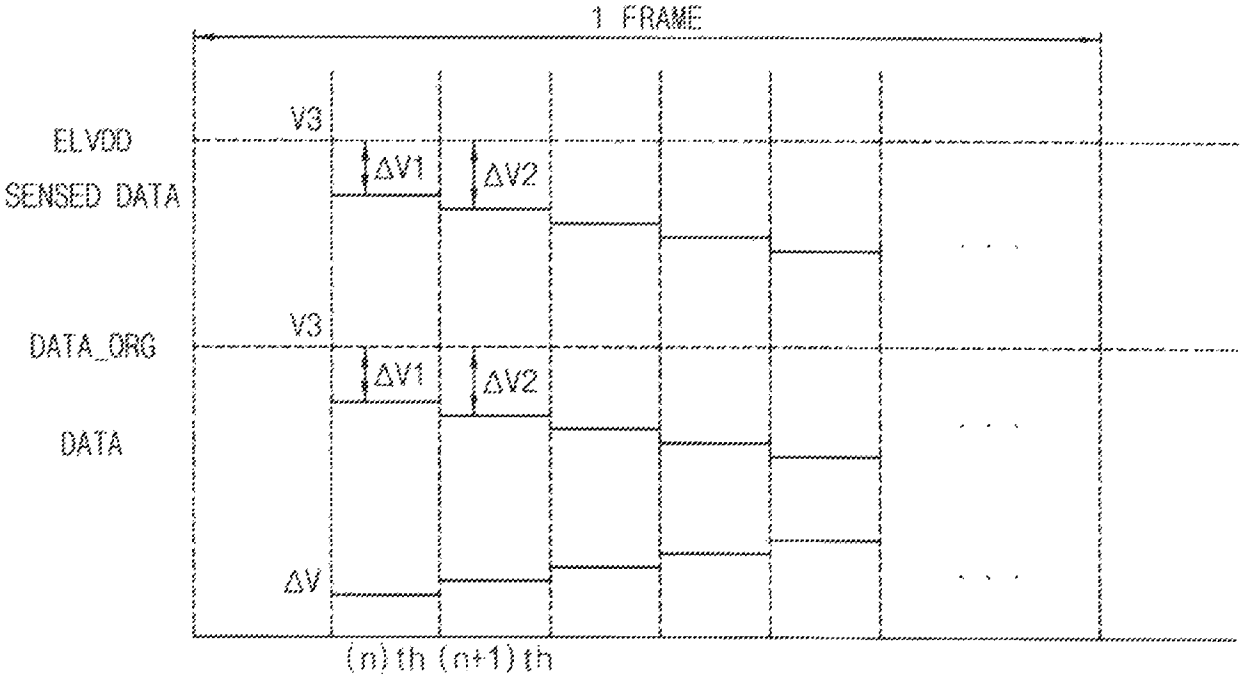
FIG. 6B is a waveform diagram illustrating an example of a data signal generated by the display device of FIG. 5.

FIG. 6A is a circuit diagram illustrating an example of a first pixel column included in the display device of FIG. 5. FIG. 6B is a waveform diagram illustrating an example of a data signal generated by the display device of FIG. 5.

Referring to FIGS. 5 and 6A, pixel columns may include dummy pixels 511-*n* and 511-*n*+1 that are electrically connected to a dummy data line 512, where n is a positive integer.

The dummy pixels 511-*n* and 511-*n*+1 may store the first data signal DATA1 in the storage capacitor Cst in response to the scan signal SCAN[n] provided from the gate driver 120. Here, the scan signal SCAN[n] may be provided to pixel rows sequentially or simultaneously.

After a certain amount of time elapses, and when a supply of the first power voltage ELVDD is stopped or interrupted, the dummy pixels 511-*n* and 511-*n*+1 may output the sensing signal SENSED DATA by sensing the local voltage level of the first power voltage ELVDD in response to sensing control signals SENSING SCAN[n] and SENSING SCAN[n+1], respectively. Here, the sensing control signals SENSING SCAN[n] and SENSING SCAN[n+1] may be provided from the gate driver 120 to the pixel rows sequentially. For example, the first dummy pixel 511-*n* may output a first sensing signal by sensing a first local voltage level supplied to the first dummy pixel 511-*n* in response to an (n)th scan signal SENSING SCAN[n]. The second dummy pixel 511-*n*+1 may output a second sensing signal by sensing a second local voltage level supplied to the second dummy pixel 511-*n*+1 in response to an (n+1)th scan signal SENSING SCAN[n+1]. The sensing signal SENSED DATA may include the first sensing signal and the second sensing signal that are sequentially outputted from the dummy pixels 511-*n* and 511-*n*+1.

As described in FIG. 6B, the local voltage level sensed by an (n)th dummy pixel may be "V3−ΔV1," which is lower than the supply voltage level by ΔV1, and the local voltage level sensed by an (n+1)th dummy pixel may be "V3−ΔV2," which is lower than the supply voltage level by ΔV2, The sensing signal may have a stepped waveform decreased with time (i.e., according to an (n)th sensing signal outputted sequentially).

The data driver 530 may calculate a voltage difference ΔV between the sensing signal SENSED DATA and the local voltage level of the first power voltage ELVDD, and may generate an error signal that represents a magnitude of a current-resistance drop of the first power voltage ELVDD for each pixel row based on the voltage difference ΔV. Here, the error signal may be expressed as only a magnitude of the voltage difference ΔV between the supply voltage level and the local voltage level.

As described with reference to FIG. 3, the data driver 530 may generate a data signal DATA supplied to the second pixel based on externally supplied image data and the error signal. For example, the data driver 530 may generate a first data signal DATA_ORG (see FIG. 6B) corresponding to the image data based on a gamma curve, and may generate a second data signal DATA (i.e., a data signal supplied to the second pixel) by reducing a size of the first data signal DATA_ORG based on the error signal. The display panel 510 may display the image data based on the second data signal DATA.

As described above, the display device 500 may sense the local voltage level of the first power voltage ELVDD using the first dummy pixel 511, and may generate the second data signal supplied to pixels arranged in a pixel row including the dummy pixel 511 based on the local voltage level (or, the sensing signal). Therefore, the display device 500 may reduce a production cost as compared to a configuration generating a data signal by sensing the local voltage level at all of the pixels.

Figure 7:
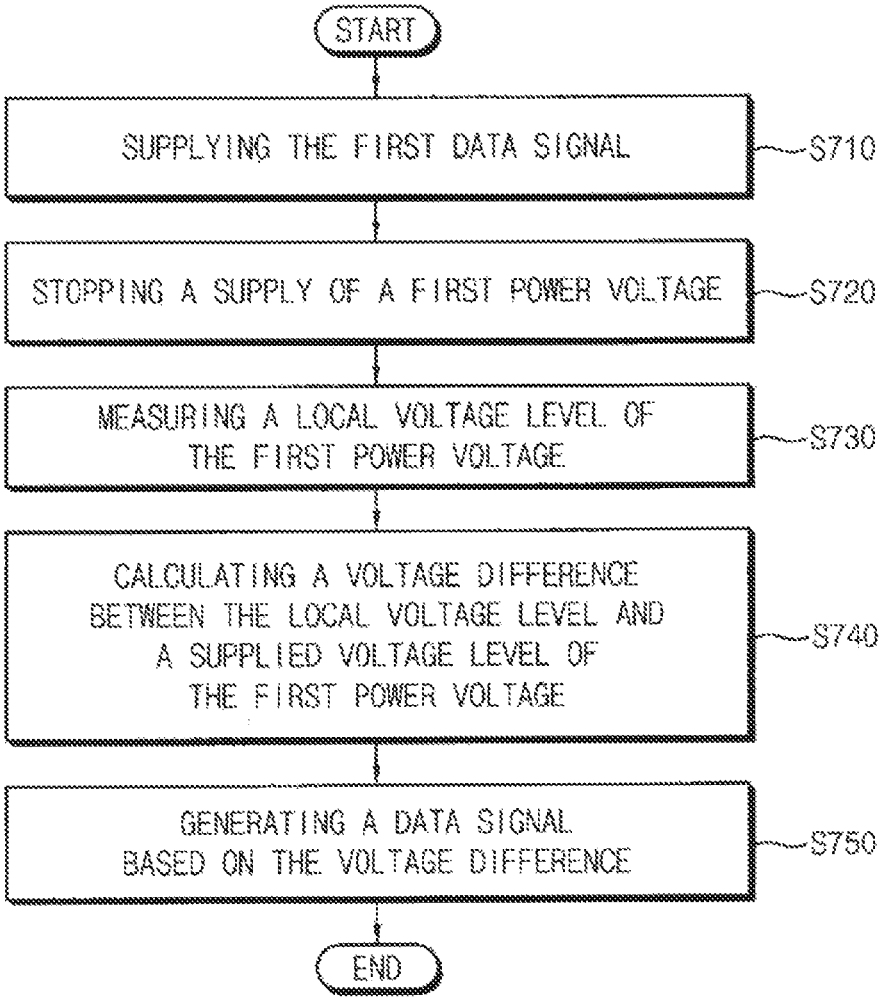
FIG. 7 is a flowchart illustrating a method of driving a display panel according to example embodiments.

FIG. 7 is a flowchart illustrating a method of driving a display panel according to example embodiments.

Referring to FIGS. 1, 2, and 7, the display device 100 may include a pixel that includes a light emitting element EL, a driving transistor TR_D including a first electrode for receiving the first power voltage ELVDD, a second electrode electrically connected to the light emitting element EL, and a gate electrode that receives the data signal, and a storage capacitor Cst electrically connected between the first electrode of the driving transistor and the gate electrode of the driving transistor.

The method of FIG. 7 may supply a first data signal DATA1 to the pixel 111 (S710). The method of FIG. 7 may provide the first data signal DATA1 to a data line, and may provide the first data signal DATA1 to the pixel 111 based on a scan signal. For example, the method of FIG. 7 may provide a scan signal SCAN[n] to pixels from the gate driver 120 simultaneously, and each of the pixels may receive the data signal DATA1 in response to the scan signal SCAN[n]. The pixel 111 may store the data signal DATA1 in the storage capacitor Cst.

After a certain amount of time elapsed (i.e., when a storage or a charging of the storage capacitor Cst is finished), the method of FIG. 7 may stop a supply of the first power voltage ELVDD to the pixel 111 (S720). The method of FIG. 7 may generate a power control signal by the timing controller 140, and may stop the supply of the first power voltage ELVDD to the pixel 111 in response to the power control signal provided by the power supplier 150.

When the supply of the first driving power is stopped, the method of FIG. 7 may generate a sensing signal by sensing/ measuring a voltage at a terminal of the storage capacitor Cst as the local voltage level in response to a sensing control signal (S730).

The method of FIG. 7 may generate a data signal based on the sensing signal (i.e., a sensed local voltage level) and image data.

For example, the method of FIG. 7 may calculate a voltage difference ΔV between the sensed local voltage level and a supply voltage level of the first power voltage (S740) and may generate the data signal based on the voltage difference ΔV and the externally supplied image data (S750). For example, the method of FIG. 7 may generate a first data signal DATA1 based on the image data, may compensate the first data signal DATA1 based on the voltage difference ΔV, and may output the first data signal DATA1 as the data signal. Here, the first data signal DATA1 may be generated by converting a gray level data based on a gamma curve.

The method of FIG. 7 may allow the display of an image based on the data signal.

The present invention may be applied to any display device (e.g., an organic light emitting display device, a liquid crystal display device, etc.). For example, the present invention may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and features of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A display device comprising:

a power supplier configured to generate a first power voltage;

a display panel comprising a pixel configured to generate a sensing signal by sensing a local voltage level of the first power voltage using a storage capacitor;

a data driver configured to generate a data signal based on image data and the sensing signal; and a gate driver configured to generate a scan signal, a sensing control signal, and a light emitting control signal, and configured to provide the display panel with the scan signal, the sensing control signal, and the light emitting control signal, wherein the power supplier is further configured to supply the first power voltage to the pixel at a high level during a first period and a second period and to supply the first power voltage to the pixel at a low level during a third period, wherein the data driver is further configured to supply the data signal to the pixel during the second period, and wherein the gate driver is further configured to supply the scan signal to the pixel at a turn-on level and the light emitting control signal at a turn-off level during the second period and to supply the sensing control signal at the turn-on level during the third period.

2. The display device of claim 1, wherein the display panel further comprises a sensing data line configured to transfer the sensing signal to the data driver.

3. The display device of claim 2, wherein the pixel comprises:

a light emitting element;

a driving transistor comprising a first electrode configured to receive the first power voltage, a second electrode that is electrically connected to the light emitting element, and a gate electrode configured to receive the data signal;

a sensing transistor comprising a first electrode that is electrically connected to the first electrode of the driving transistor, a second electrode that is electrically connected to the sensing data line, and a gate electrode configured to receive the sensing control signal; and a light emitting transistor between the driving transistor and the light emitting element and comprising a gate electrode configured to receive the light emitting control signal, wherein the storage capacitor is electrically connected between the first electrode of the driving transistor and the gate electrode of the driving transistor.

4. The display device of claim 1, wherein the pixel is configured to sense a voltage at a terminal of the storage capacitor as the local voltage level when a supply of the first power voltage is stopped.

5. The display device of claim 1, wherein the gate driver is configured to control the pixel to store the data signal in the storage capacitor based on the scan signal, and configured to control the pixel to sense the local voltage level based on the sensing control signal.

6. The display device of claim 5, further comprising a timing controller configured to generate a power control signal to stop a supply of the first power voltage by the power supplier.

7. The display device of claim 5, wherein the display panel comprises a plurality of display regions, and wherein the gate driver is configured to provide mutually independent scan signals to the display regions, respectively.

8. The display device of claim 1, wherein the data driver is configured to calculate a voltage difference between the sensing signal and a voltage level of the first power voltage, and configured to generate the data signal based on the image data and the voltage difference.

9. The display device of claim 8, wherein the data driver is configured to generate a first data signal based on the image data, is configured to compensate the first data signal based on the voltage difference, and is configured to output a compensated first data signal as the data signal.

10. The display device of claim 9, wherein the data driver is configured to reduce the first data signal by the voltage difference.

11. The display device of claim 8, wherein the power supplier is configured to sense a supply voltage level of the first power voltage.

12. A display device comprising:

a power supplier configured to generate a first power voltage;

a display panel comprising:

a first pixel column comprising a first pixel configured to generate a sensing signal by sensing a local voltage level of the first power voltage using a storage capacitor; and a second pixel column comprising a second pixel;

a data driver configured to generate a data signal based on image data and the sensing signal; and a gate driver configured to generate a scan signal, a sensing control signal, and a light emitting control signal, and configured to provide the display panel with the scan signal, the sensing control signal, and the light emitting control signal, wherein the second pixel is configured to emit light based on the data signal, wherein the power supplier is further configured to supply the first power voltage to the first pixel at a high level during a first period and a second period and to supply the first power voltage to the first pixel at a low level during a third period, wherein the data driver is further configured to supply the data signal to the first pixel during the second period, and wherein the gate driver is further configured to supply the scan signal to the first pixel at a turn-on level and the light emitting control signal at a turn-off level during the second period and to supply the sensing control signal at the turn-on level during the third period.

13. The display device of claim 12, wherein the display panel comprises a sensing data line that is electrically connected between the first pixel column and the data driver, and that is configured to transfer the sensing signal to the data driver.

14. The display device of claim 13, wherein the first pixel comprises:

a light emitting element;

a driving transistor comprising a first electrode that is configured to receive the first power voltage, a second electrode that is electrically connected to the light emitting element, and a gate electrode configured to receive the data signal;

a sensing transistor comprising a first electrode that is electrically connected to a first electrode of the driving transistor, a second electrode that is electrically connected to the sensing data line, and a gate electrode configured to receive the sensing control signal; and a light emitting transistor between the driving transistor and the light emitting element and comprising a gate electrode configured to receive the light emitting control signal, wherein the storage capacitor is electrically connected between the first electrode of the driving transistor and the gate electrode of the driving transistor.

15. The display device of claim 14, wherein the first pixel is configured to sense a voltage at a terminal of the storage capacitor as the local voltage level when a supply of the first power voltage is stopped.

16. The display device of claim 12, wherein the data driver is configured to calculate a voltage difference between the sensing signal and a supply voltage level of the first power voltage, and is configured to generate the data signal based on the image data and the voltage difference.

17. The display device of claim 12, wherein the gate driver is configured to control the first pixel to store the data signal in the storage capacitor based on the scan signal, and is configured to control the first pixel to sense the local voltage level based on the sensing control signal.

18. A method of driving a display device comprising a pixel that comprises a light emitting element, a driving transistor that comprises a first electrode that is configured to receive a first power voltage, a second electrode electrically connected to the light emitting element, and a gate electrode that is configured to receive a data signal, a light emitting transistor between the driving transistor and the light emitting element and comprising a gate electrode that is configured to receive a light emitting control signal, and a storage capacitor that is electrically connected between the first electrode of the driving transistor and the gate electrode of the driving transistor, the method comprising:

supplying the first power voltage to the pixel during a first period and a second period;

supplying a second data signal to the pixel during the second period;

supplying the light emitting control signal to the pixel at a turn-on level during the second period;

generating a sensing signal by sensing a voltage at a terminal of the storage capacitor as a local voltage level of the first power voltage during a third period; and generating the data signal based on image data and the sensing signal.

19. The method of claim 18, wherein generating the sensing signal comprises:

stopping a supply of the first power voltage during the third period;

disconnecting the driving transistor and the light emitting element; and sensing the voltage at the terminal of the storage capacitor.

20. The method of claim 18, wherein generating the data signal comprises:

calculating a voltage difference between the sensing signal and a supply voltage level of the first power voltage; and generating the data signal based on the image data and the voltage difference.

* * * * *